US006427805B1

(12) United States Patent
Gibson et al.

(10) Patent No.: US 6,427,805 B1
(45) Date of Patent: Aug. 6, 2002

(54) FOLDING STEP STOOL

(75) Inventors: William R. Gibson, Kent, OH (US); Enrique R. Giner; Maria Antonieta Moreno-Giner, both of Huntington Woods, MI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/762,537

(22) PCT Filed: Jan. 7, 2000

(86) PCT No.: PCT/US00/00280

§ 371 (c)(1),
(2), (4) Date: Feb. 8, 2001

(87) PCT Pub. No.: WO00/40824

PCT Pub. Date: Jul. 13, 2000

Related U.S. Application Data

(60) Provisional application No. 60/115,059, filed on Jan. 8, 1999, and provisional application No. 60/149,370, filed on Aug. 13, 1999.

(51) Int. Cl.[7] ..... E06C 1/00

(52) U.S. Cl. ..... 182/165

(58) Field of Search ..... 182/165, 46, 180.1, 182/129, 161, 162, 163, 22–26; D25/64, 65

(56) References Cited

U.S. PATENT DOCUMENTS

| | | | | |
|---|---|---|---|---|
| 162,075 A | | 4/1875 | Isaacs et al. | |
| 1,702,249 A | | 2/1929 | Davidson | |
| 2,109,886 A | | 3/1938 | Lewis | |
| 2,207,923 A | | 7/1940 | Kelso | |
| 2,525,104 A | | 10/1950 | Cyr | |
| 2,596,521 A | * | 5/1952 | Bell | 182/165 X |
| 3,446,311 A | * | 5/1969 | Alfie | 182/156 X |
| 3,999,629 A | | 12/1976 | Schaffer et al. | |
| 4,485,892 A | | 12/1984 | Maloney et al. | |
| 4,502,564 A | | 3/1985 | Kummerlin et al. | |
| 5,064,243 A | | 11/1991 | Quain | |
| 5,722,507 A | * | 3/1998 | Kain | 182/165 X |
| 5,762,163 A | | 6/1998 | Kain | |
| 5,937,968 A | | 8/1999 | Gibson et al. | |
| 5,967,260 A | * | 10/1999 | Spak | 182/165 |

FOREIGN PATENT DOCUMENTS

| | | | | |
|---|---|---|---|---|
| DE | 3320315 A1 | * | 12/1984 | 182/165 |
| DE | 3327025 A1 | * | 2/1985 | 182/165 |
| IT | 0065492 A2 | * | 11/1982 | 182/165 |

OTHER PUBLICATIONS

11–135 Two Step™ Folding Step Stool, Cosco® A Dorel Company, Home Furnishings, 1996, p. 17. No Month Available.

11–302 Big Step™ Folding Step Stool and 11–307 Deluxe Big Step™.

Folding Step Stool/Chair, Cosco® A Dorel Company, Home Furnishings, 1996, p. 18 No Month Available.

* cited by examiner

*Primary Examiner*—Daniel P. Stodola
*Assistant Examiner*—Hugh B. Thompson
(74) *Attorney, Agent, or Firm*—Barnes & Thornburg

(57) ABSTRACT

A foldable step steel (10) includes a frame 12 having front and rear legs (14, 16) and top, middle, and bottom steps (34, 36, 38). A central step link (40) is coupled to the rear portion of each step (34, 36, 38) to support the steps when step stool (10) is unfolded and to control pivoting movement of the steps relative to front leg (14) during folding of step stool (10). A releasable latch (22) is coupled to a rear portion of top step (34) and configured to engage an upper cross strut (180) included in rear leg (16) to retain step stool (10) in an unfolded use position.

57 Claims, 10 Drawing Sheets

114
32
30
120
30
10
12
124
122
42
124
172
172
160
160
50
26
28
29
94
35
22
20
49
34
128
14
96
95
180
62
140
31
50
44
44
40
49
16
36
128
44
44
46
20
96
94
62
70
182
40
48
104
24
38
128
24
104
96
94
62
70
18
104
20
100
102
100
18
104
100
102

FOLDING STEP STOOL

This claims priority under 35 U.S.C. §119(e) to U.S. Provisional Application Serial No. 60/115,059, filed Jan. 8, 1999, which is expressly incorporated by reference herein and to U.S. Provisional Application Serial No. 60/149,370, filed Aug. 13, 1999, which is expressly incorporated by reference herein.

BACKGROUND AND SUMMARY OF THE INVENTION

The present invention relates to a step stool, and particularly, to a folding step stool having legs that fold between an opened use position and a closed storage position. More particularly, the present invention relates to a folding step stool provided with a step support-and-release system for the pivotable steps included in the step stool.

Step stools have a frame and one or more steps that individuals use for elevation when reaching for objects, painting walls, or any everyday task where extra elevation would be helpful. Step stool frames are often foldable for ease of storage while the step stool is not being used.

According to the present invention, a step stool includes a frame, steps coupled to the frame, and a central step link coupled to the steps. The frame includes a front leg and a rear leg coupled to the front leg and arranged to move relative to the front leg between an opened use position and a closed storage position. The steps are coupled to the front leg for pivotable movement between a horizontal position when the rear leg is in the opened use position and a vertical position when the real leg is in the storage position. The central step link is pivotably coupled to a middle portion of the steps to support the steps when the step stool is in the opened use position and to control simultaneous movement of the steps relative to the front leg as the step stool is folded to move between the use and storage positions.

In preferred embodiments. the rear leg further includes an upper cross strut arranged to lie under and in engagement with the top step when the step stool is in the opened use position. A spring-biased releasable latch is pivotably coupled to a rear edge of the top step and arranged to engage the upper cross strut when the front and rear legs are in the opened use position to retain the step stool in that position. The releasable latch can be operated manually by a user to disengage the upper cross strut to facilitate folding of the step stool.

A utility tray is positioned to lie above the top step and is pivotably coupled to a pivot bracket that is coupled to the front and rear legs. A pair of tray links are pivotably coupled at upper ends to the tray and at lower ends to side portions of the top step. These tray links operate to raise and lower the utility tray in response to movement of the top step during unfolding and folding of the step stool.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 8 is a sectional view taken along lines 8—8 of FIG. 2 showing the releasable latch coupled to the top step and a spring biasing the latch to cause the latch to pivot about a pin to a latched position engaging the upper cross strut of the rear leg so as to couple the top step to the rear leg, thereby retaining the step stool in the use position;

FIG. 9 is a sectional view taken along lines 9—9 of FIG. 2 showing the releasable latch having a finger-grip portion and a user gripping the finger-grip portion to pivot the latch about a pivot point established by the pin in a counterclockwise direction, shown by the arrow, to release the latch from engagement with the upper cross strut of the rear leg;

FIG. 10 is a sectional view similar to FIG. 9 showing the releasable latch pivoted further by the user in the direction of the double arrow so that the latch is released from the upper cross strut to permit the rear leg to be moved (to the left) toward the storage position;

FIG. 11 is a sectional view similar to FIGS. 8, 9, and 10 showing motion of the latch relative to the upper cross strut as a cam surface on a tip of the latch slides on an exterior surface of the upper cross strut as the step stool is moved to assume the opened use position;

DETAILED DESCRIPTION OF THE DRAWINGS

Figure 1:
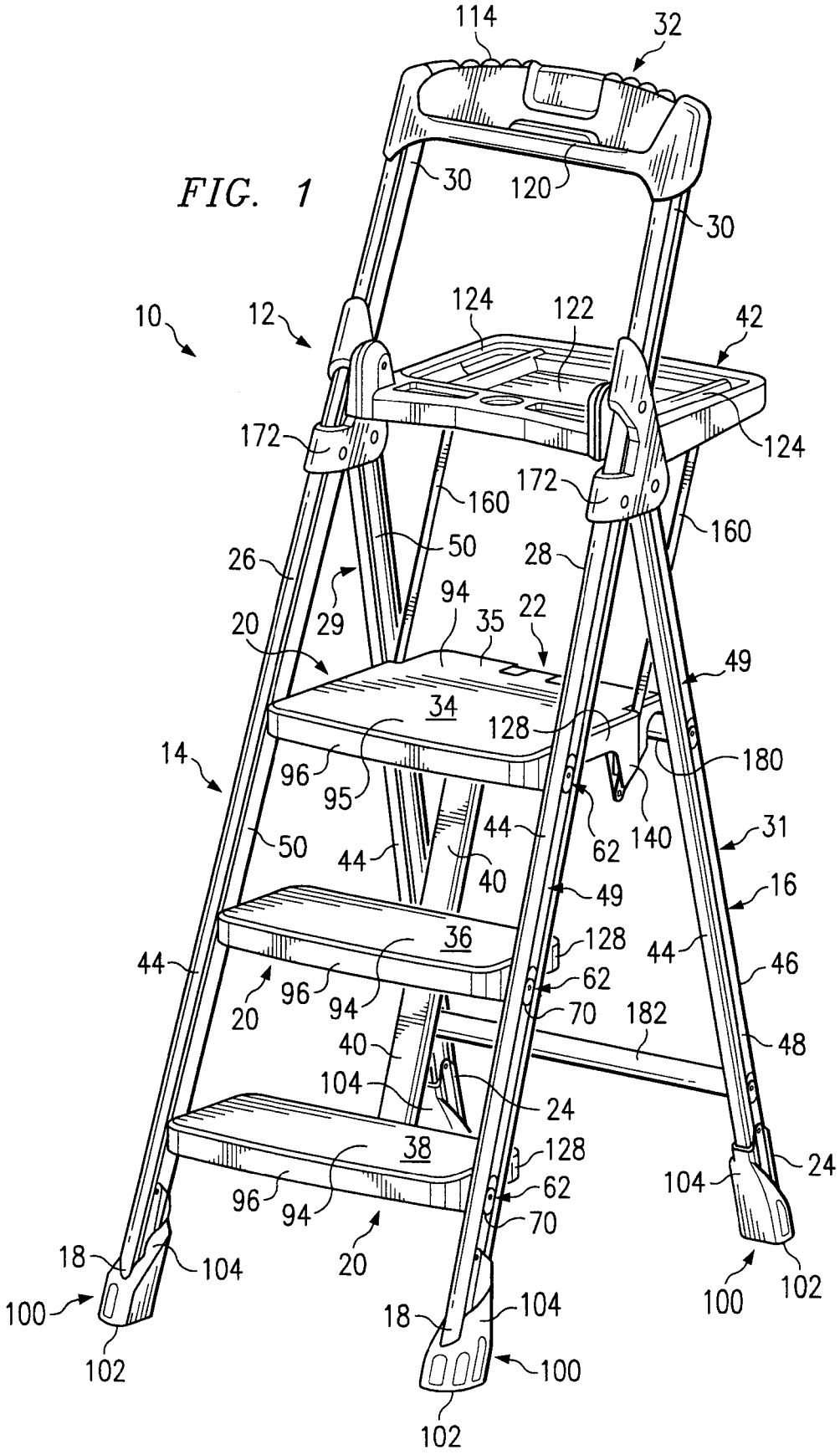
FIG. 1 is a front perspective view of a step stool in accordance with the present disclosure showing a frame having front and rear legs situated in an opened use position and a pivot bracket coupled to the front and rear legs, top, middle, and bottom steps pivotably coupled to the front leg, a handle portion coupled to a top end of the front leg, the pivot bracket being positioned to lie between the top step and the handle portion, and a utility tray pivotably coupled to the pivot bracket and positioned to lie above the top step.
Figure 3:
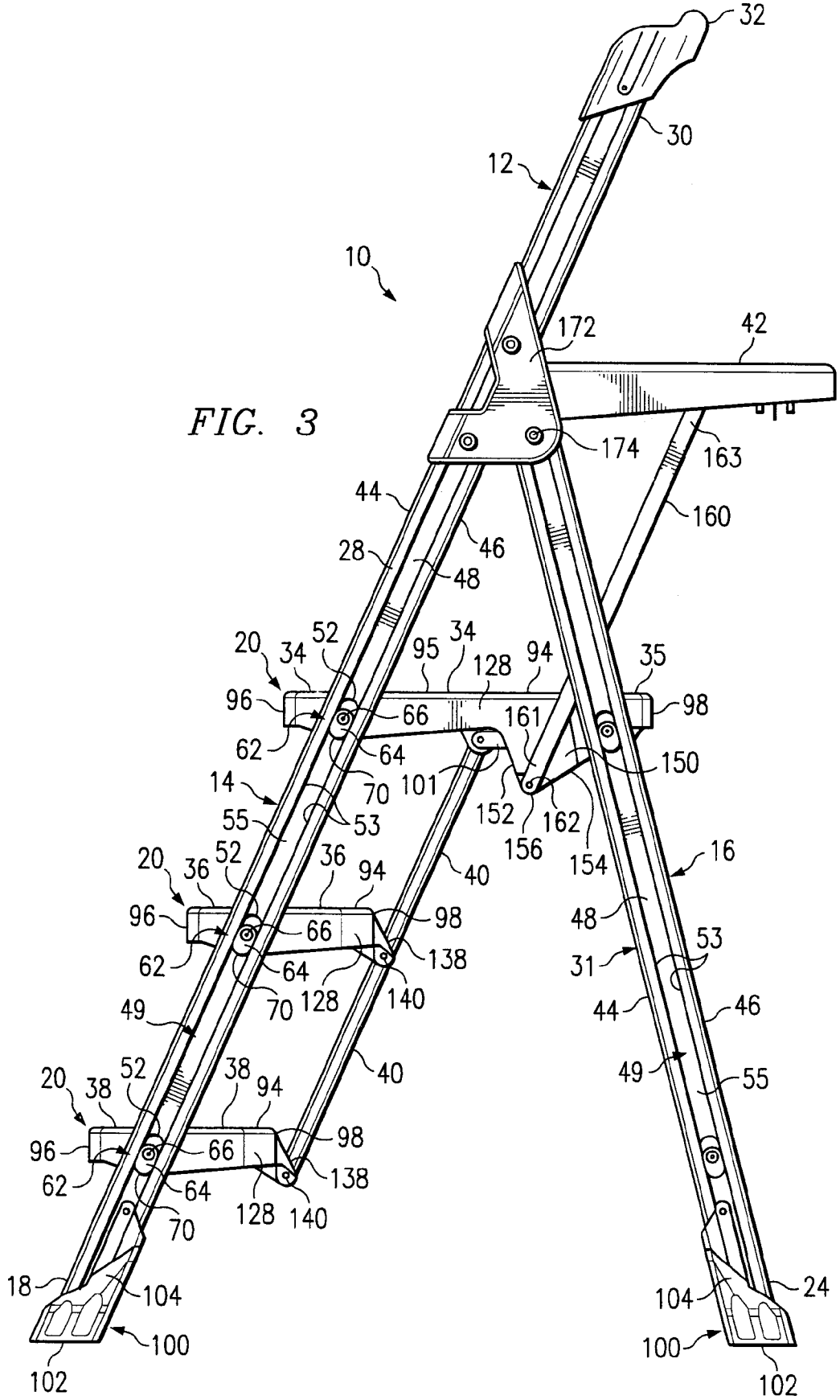
FIG. 3 is a right side elevation view of the step stool of FIG. 1 showing a central step link coupled to rear portions of the top, middle, and bottom steps and one of two tray links coupled to the utility tray and to the top step.
Figure 4:
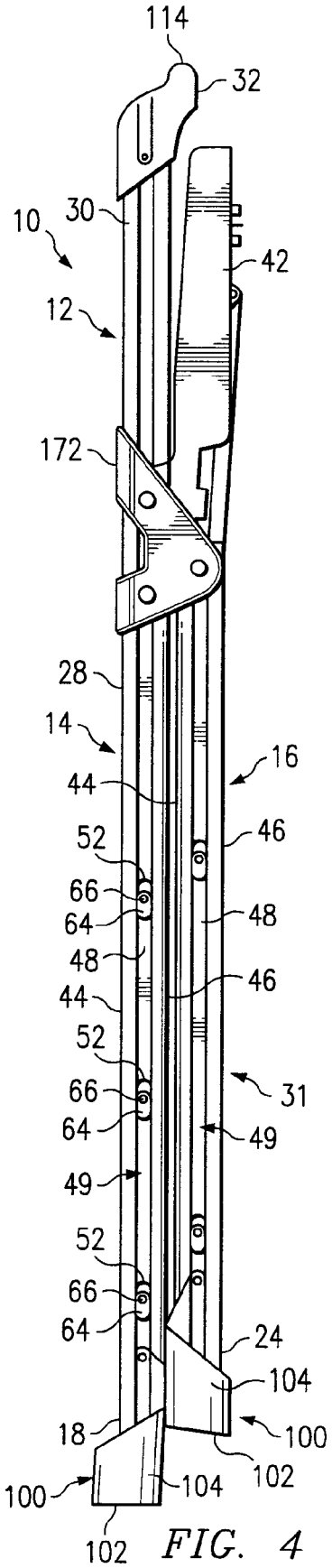
FIG. 4 is a view similar to FIG. 3 of the step stool in the closed storage position showing the utility tray positioned to lie in a vertical storage position generally above the pivot bracket and generally below the handle portion.
Figure 5:
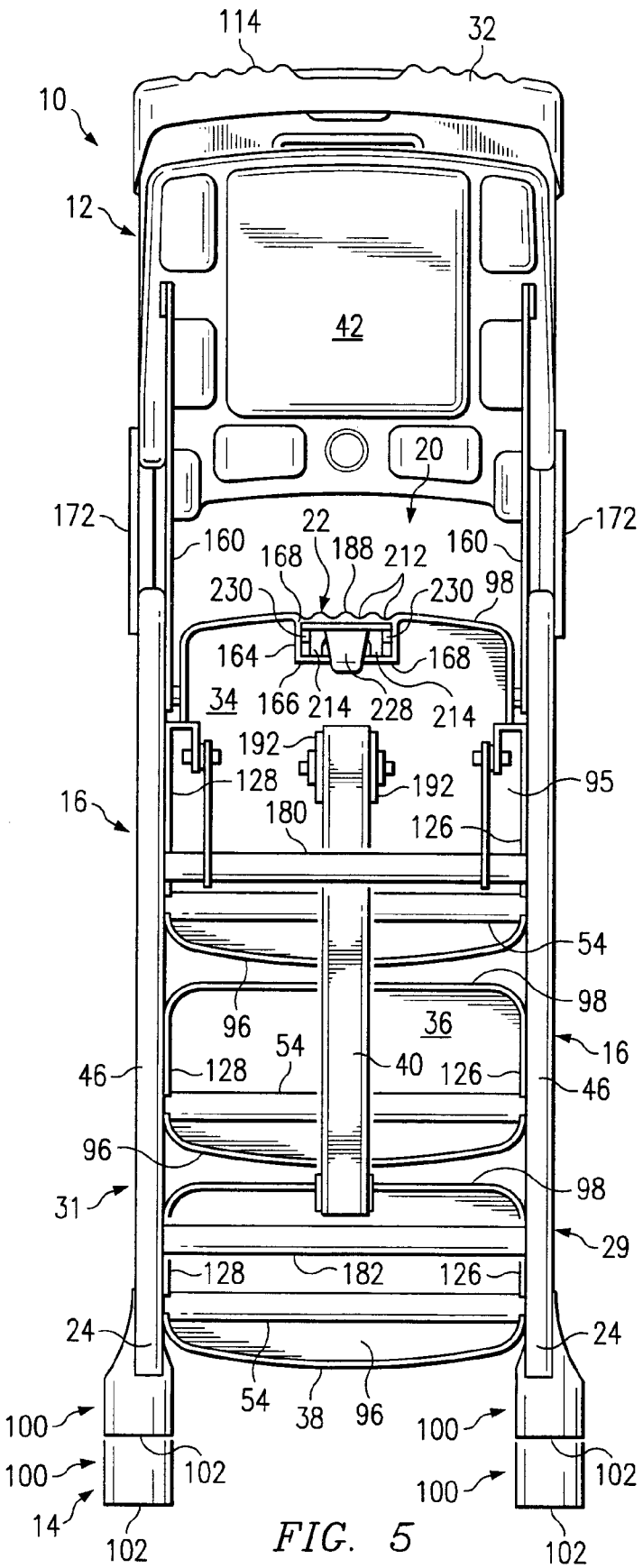
FIG. 5 is a rear elevation view of the step stool in the closed storage position of FIG. 4 showing the central step link coupled to rear portions of each of the steps and two laterally spaced-apart tray links coupled at lower ends to the top step and at upper ends to a central portion of the utility tray.

A foldable step stool 10 includes a frame 12 having a front leg 14, a bracket 172 coupled to front leg 14, and a real leg 16 pivotably coupled to bracket 172 so that step stool 10 can be folded from an opened use position shown in FIGS. 1 and 3 to a closed storage position shown in FIGS. 4 and 5. Step stool 10 further includes three steps 20 and each step 20 is pivotably coupled to front leg 14. Steps 20 include a top step 34, a middle step 36, and a bottom step 38.

Figure 8:
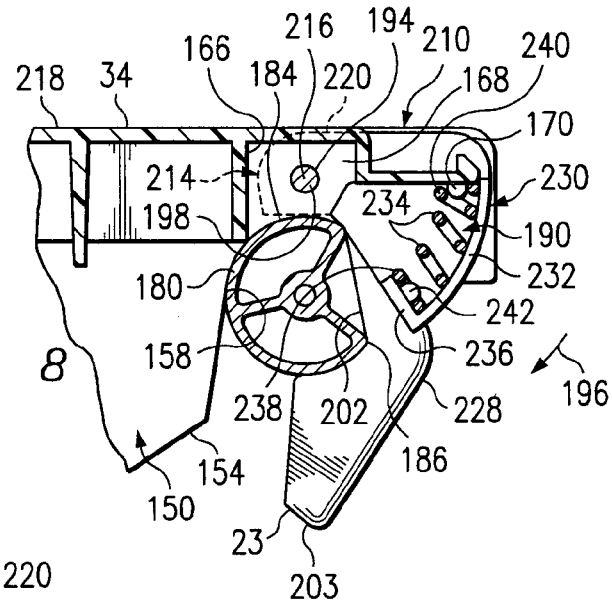
FIGS. 8–11 show a sequence wherein the releasable latch coupled to the rear portion of the top step is operated to disengage the latch from the upper cross strut of the rear leg to facilitate folding of the step stool.
Figure 9:
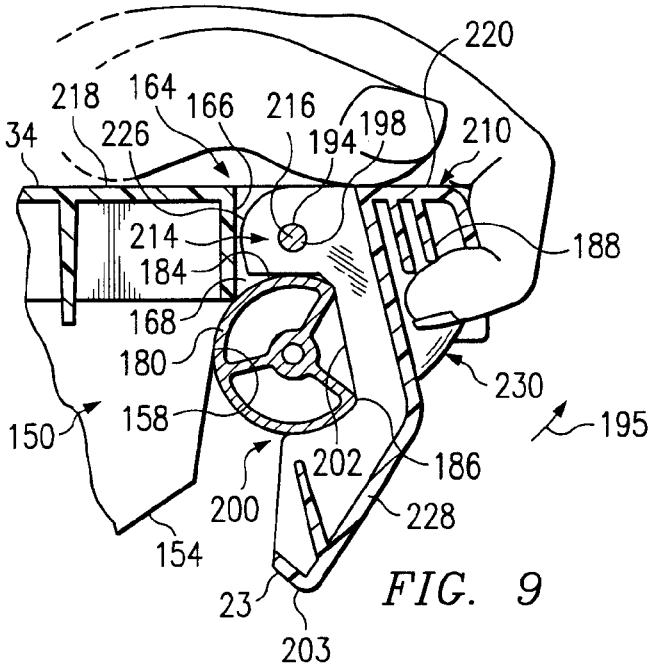
Figure 10:
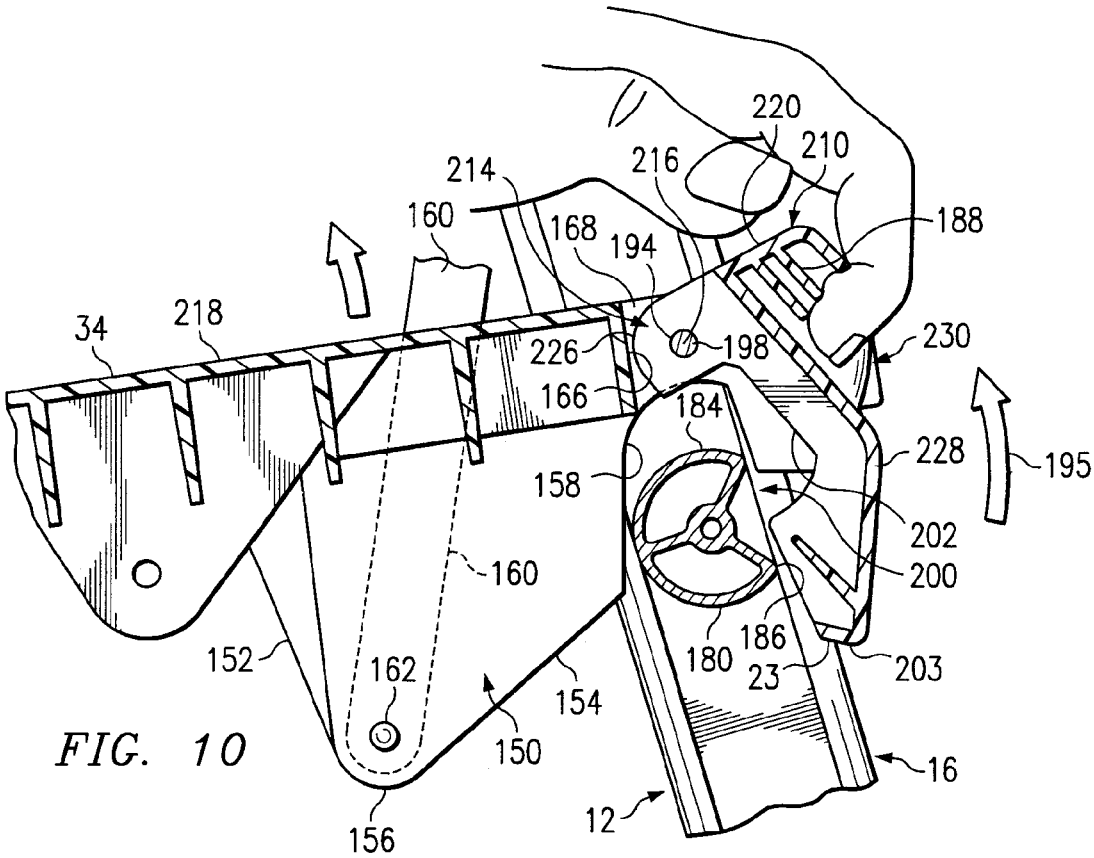
Figure 11:
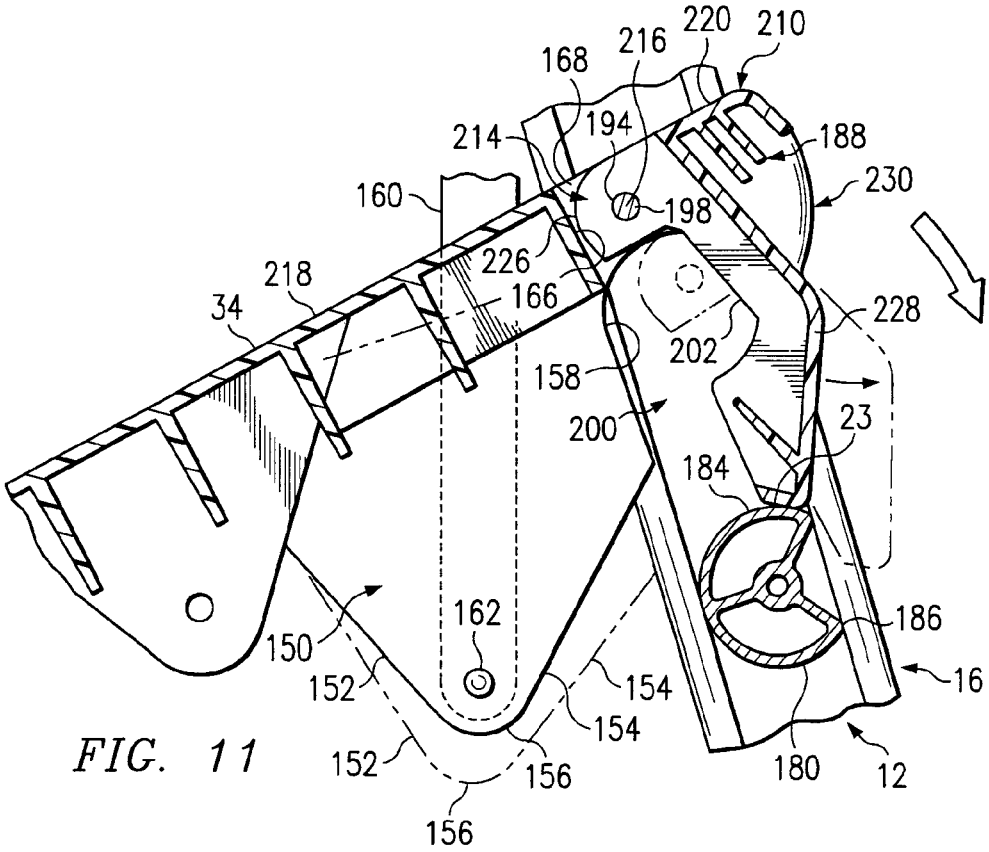
Figure 12:
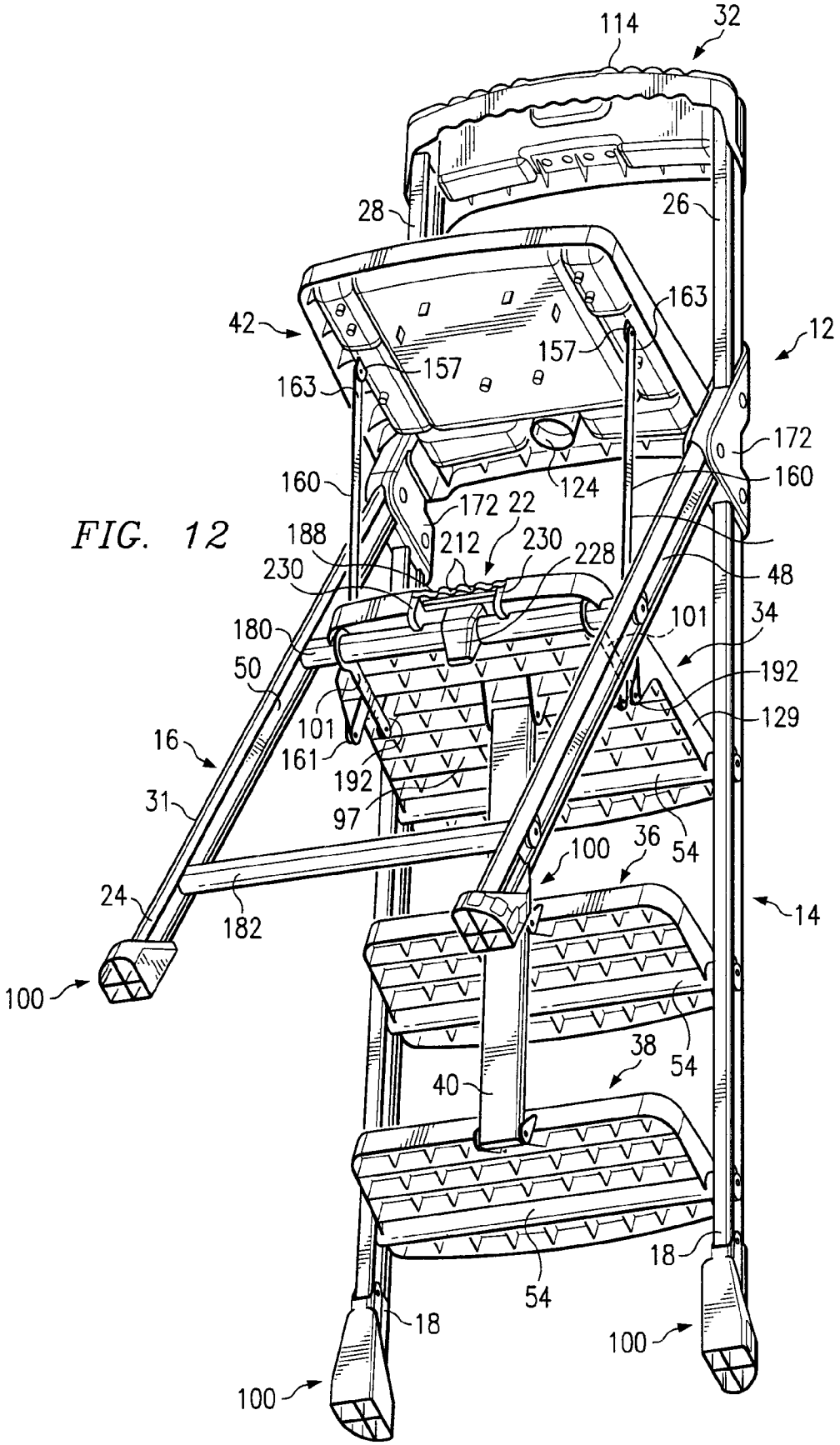
FIG. 12 is a perspective view of the underside of the step stool of FIGS. 1–11 in the use position showing the central step link coupled to each of the three steps, the releasable latch coupled to the rear portion of the top step, and a pair of short strut links positioned to lie under the top step wherein each strut link is pivotably coupled at one end to the upper cross strut and at an opposite end to the top step.

Each step 20 is pivotably coupled to a central step link 40 that is coupled to a rear portion of each of the steps 20 so as to support the steps 20 in a horizontal orientation as shown in FIG. 3 upon movement of step stool 10 to the opened use position and to control pivoting movement of steps 20 relative to front leg 14 during movement of step stool 10 between the use and storage positions. A releasable latch 22 is coupled to a rear portion of top step 34 and configured to engage an upper cross strut 180 included in rear leg 16 to retain step stool 10 in the use position as shown in FIGS. 1–3 and 8 and to be disengaged from upper cross strut 180 as shown in FIGS. 9–11 to facilitate folding of step stool 10. A pair of strut links 101 are positioned to lie under top step 34 as shown in FIGS. 5 and 12 and each strut link 101 is pivotably coupled at one end to upper cross strut 180 and at an opposite end to a middle portion of top step 34 to regulate motion of top step 34 relative to real leg 16 during folding and unfolding of step stool 10.

Figure 2:
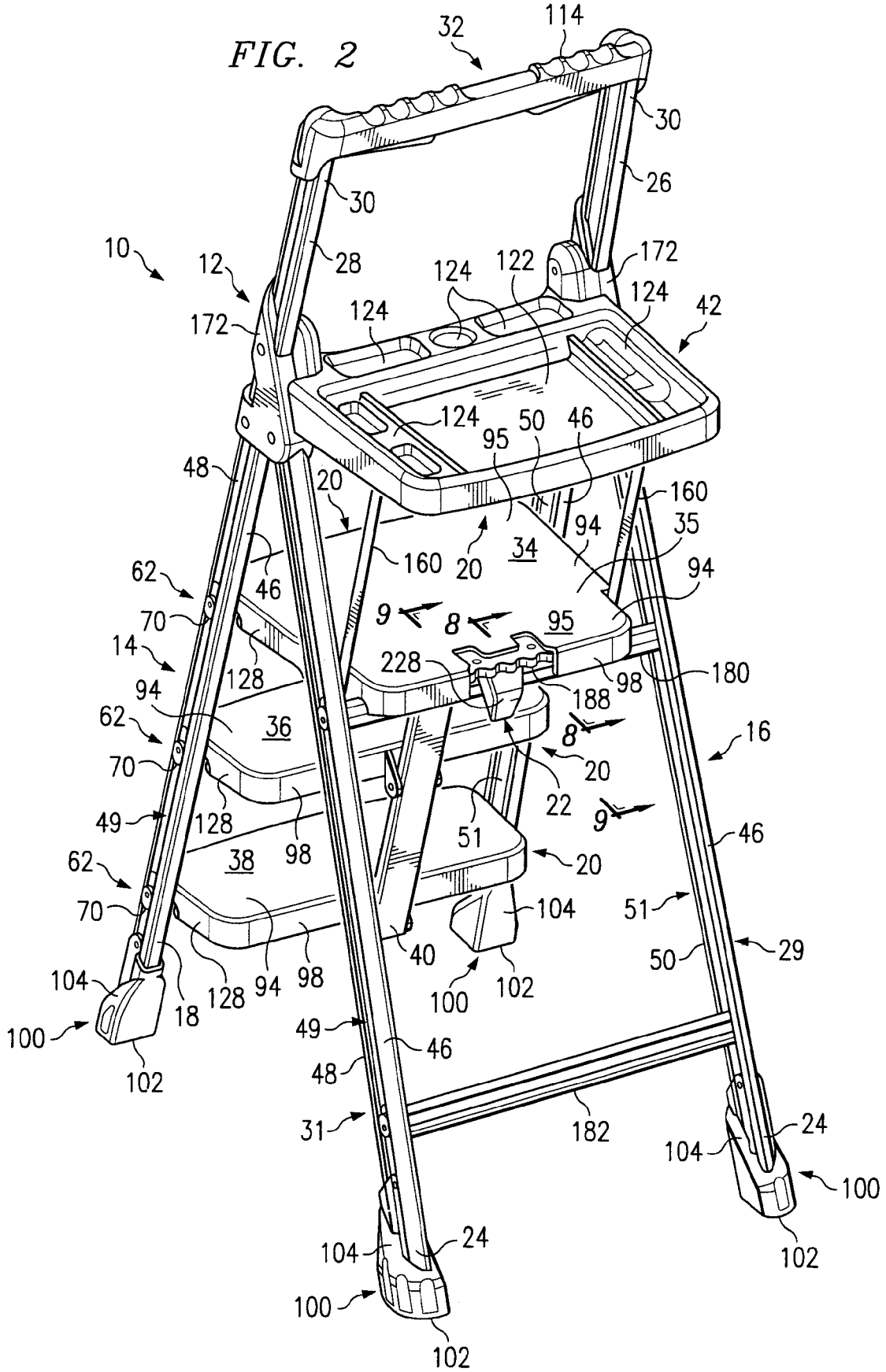
FIG. 2 is a rear perspective view of the step stool of FIG. 1 showing the rear leg including two spaced-apart rear leg members, an upper cross strut coupled to the rear leg members and positioned to lie under and support a real portion of the top step, and a releasable latch pivotably coupled to the rear portion of the top step and arranged to engage the upper cross strut when the front and rear legs of the step stool are in the use position to retain the step stool in that position.

Frame 12 of step stool 10 is foldable between an opened use position, shown in FIGS. 1 and 2, in which a bottom end 18 of front leg 14 is spaced-apart from a bottom end 24 of rear leg 16 and a closed or collapsed storage position, as shown in FIGS. 4 and 5, in which front and rear legs 14, 16 are folded together. As shown in FIG. 1, front leg 14 of frame 12 includes opposite front leg members 26, 28 each including a bottom end 18 and an opposite top end 30.

A handle portion 32 extends between front leg members 26, 28 and steps 20 are spaced apart from one another and arranged to lie between handle portion 32 and bottom end 18 of front leg 14. Steps 20 include three steps (top step 34, middle step 36, and bottom step 38) coupled together by a central step link 40, as shown best in FIGS. 1–3, 5, and 12, although greater or fewer than three steps may be used. While front leg members 26, 28 are preferably constructed of extruded aluminum, a wide variety of metallic and nonmetallic materials may be used to form front leg members 26, 28.

Figure 6:
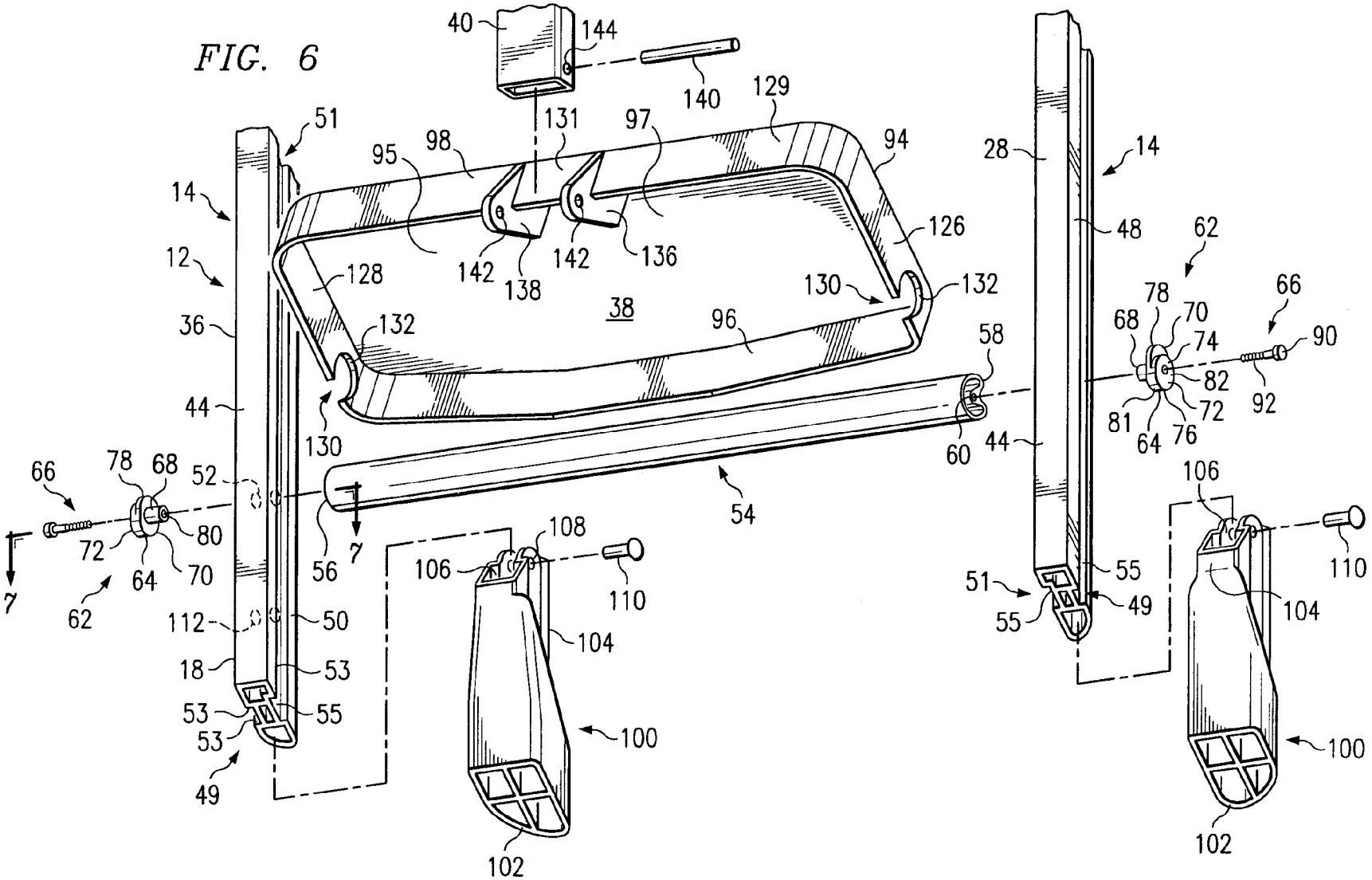
FIG. 6 is an enlarged exploded assembly view of a portion of the front leg, the bottom step, and a lower end of the central step link of FIG. 1, showing the front leg including spaced-apart front leg members, feet configured to be mounted to lower ends of the front leg members, a tubular step support extending between the front leg members to support the bottom step, and a pair of connectors positioned to lie in slots formed in each front leg member and configured to cooperate with the step supports to allow the bottom step to pivot on the step support when the central step link moves relative to the feet.

Referring now to FIGS. 4–7, each front leg member 26, 28 includes a front surface 44, a back surface 46, side walls 48, 50 extending between front and back surfaces 44, 46, and a hole 52 extending between side walls 48, 50. As best shown in FIGS. 4–6, side wall 48 includes a first track 49 formed therein and side wall 50 includes a second tack 51 formed therein. Tracks 49, 51 are each defined by a lip 53 and a floor 55.

Feet 100 are formed to fit over lower ends 18 of front leg members 26, 28. Each foot 100 includes a base 102 configured to rest upon a generally flat surface (not shown) and a sleeve portion 104 defining a cavity 106 sized to receive the bottom end of one of the leg members. Sleeve portion 104 is formed to include an aperture 108 therethrough that is sized to receive a pin 110. Pin 110 is sized to extend through aperture 108 and an aperture 112 formed in companion front leg member 26, 28 to couple each foot 100 to one of the front leg members as shown, for example, in FIG. 6. Feet 100 are mounted on rear leg members 29, 31 in a similar manner.

Figure 7:
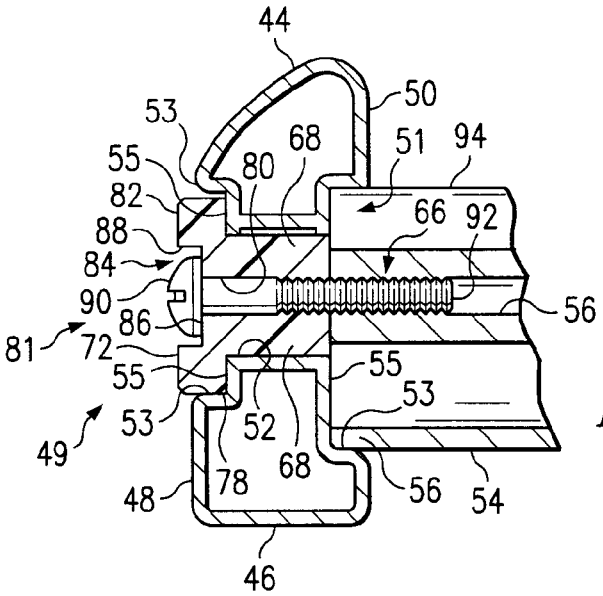
FIG. 7 is an assembled cross-sectional view taken along lines 7—7 of FIG. 6 showing one front leg member including inner and outer faces and an aperture extending between the inner and outer faces, the tubular step support engaging the inner face and including a passageway therethrough, the connector including a plug extending into the aperture and engaging the outer face, and a screw extending through the plug and into the passageway of the tubular step support to couple the step support to the front leg member.

Three step supports 54, one of which is shown in FIGS. 6 and 7, extend between and are coupled to side walls 50 of front leg members 26, 28. Step supports 54 are generally tubular and cylindrical in shape and include opposite ends 56, 58 formed to extend into second track 51 and a passageway 60 that extends between ends 56, 58. As shown in FIG. 7, ends 56, 58 engage floor 55 of second tracks 51 and lip 53 of each track 51 prevents generally horizontal movement of step support 54 relative to front leg members 26, 28. Passageway 60 is positioned to lie in general alignment with hole 52 of front leg members 26, 28.

Referring now to FIG. 6, front leg members 26, 28 are coupled to step supports 54 by a connector 62 that extends through hole 52 and into passageway 60. Connector 62 includes a mount 64 and a screw 66. Mount 64 is formed to include a post 68 sized to extend through hole 52, a generally oval rim 70 extending from post 68, a seat 72 coupled to rim 70, and a passageway 80 extending between seat 72 and post 68. Rim 70 includes a top side 74, formed to engage floor 55, a bottom side 76, coupled to seat 72, and a perimeter edge 78 extending between top and bottom sides 74, 76. Perimeter edge 78 is sized to prevent rotation of mount 64 within first track 49. Seat 72 includes an outer surface 82 that faces away from rim 70 and is formed to include a recess 84 therein. Recess 84 is defined by a base wall 86 and a side wall 88 95 extending about base wall 86. Screw 66 extends through passageway 80 formed through base wall 86. Screw 66 includes a head 90 formed for engagement with base wall 86 and a threaded shaft 92 formed to extend through passageway 80 and into passageway 60 to couple step support 54 on front leg members 26, 28.

As shown in FIGS. 1 and 2, handle portion 32 includes a top surface 114 providing finger grips and extending between front leg members 26, 28. Handle portion 32 includes a shelf 120 spaced apart from top surface 114 to receive miscellaneous items such as screws, nails, bolts, nuts, etc. It is within the scope of the present disclosure to form the shelf to include spaced-apart apertures or recesses (not shown) that are sized to receive tool shafts (not shown).

Referring now to FIG. 1, a utility tray 42 is pivotably coupled to frame 12 and positioned to lie in spaced-apart relation to and between top step 34 and handle portion 32. Utility tray 42 includes a tray surface 122 formed to include compartments 124 sized to receive nuts, bolts, screws, pens, rulers. and the like. It is within the scope of the present disclosure to form the utility tray to include a wide variety of apertures and compartments, or a Generally flat surface.

As shown in FIGS. 1–3, steps 20 of frame 12 are coupled to step supports 54 and extend between side walls 48, 50 of front leg members 26, 28. Top step 34 is positioned to lie in spaced-apart relation from tray 42 and bottom step 38 is positioned to lie between top step 34 and bottom end 18 of front leg 14. Middle step 36, is positioned to lie between top and bottom steps 34, 38. Referring now to FIG. 6, each step 20 include a support panel 95 having upper step surface 94. an underside surface 97, front and back panels 96, 98, and side panels 126, 128 that extend from step surface 94 toward end 18 to define a lip 129 coupled to the perimeter of support panel 95. Side panels 126,128 each include a generally concave rim 132 defining a slot 130, as shown in FIG. 6. extending toward step surface 94. Each rim 132 rests and pivots upon respective step support 54 when step stool 10 is moved between the opened and storage positions.

As shown in FIG. 6, back panels 98 of steps 20 are formed to include mounts 136, 138 that cooperate to define a space 139 configured to receive a portion of central step link 40 therein. Each step 34, 36, 38 is pivotably coupled to central step link 40 by a pivot pin 140. Pivot pin 140 snaps through apertures 144, 142 formed in central step link 40 and mounts 136, 138 respectively, although a wide variety of pins, rods, and the like may be used. In the illustrated embodiment, central step link 40 is positioned to lie in space 139 formed in top and middle steps 34, 36, while central step link 40 is sized to terminate near its pivotable coupling to bottom step 38. In alternative embodiments, mounts 136, 138 could be formed in back panel 98 and space 139 could run the length of steps 20 such that the space 139 receives central step link 40, thereby permitting step stool 10 to be folded substantially flat so as not to impede folding due to the thickness of central step link 40. Any termination of central step link 40 near its pivotable coupling to bottom step 38 would render it unnecessary for space 139 to run the width of bottom step 38.

Figure 13:
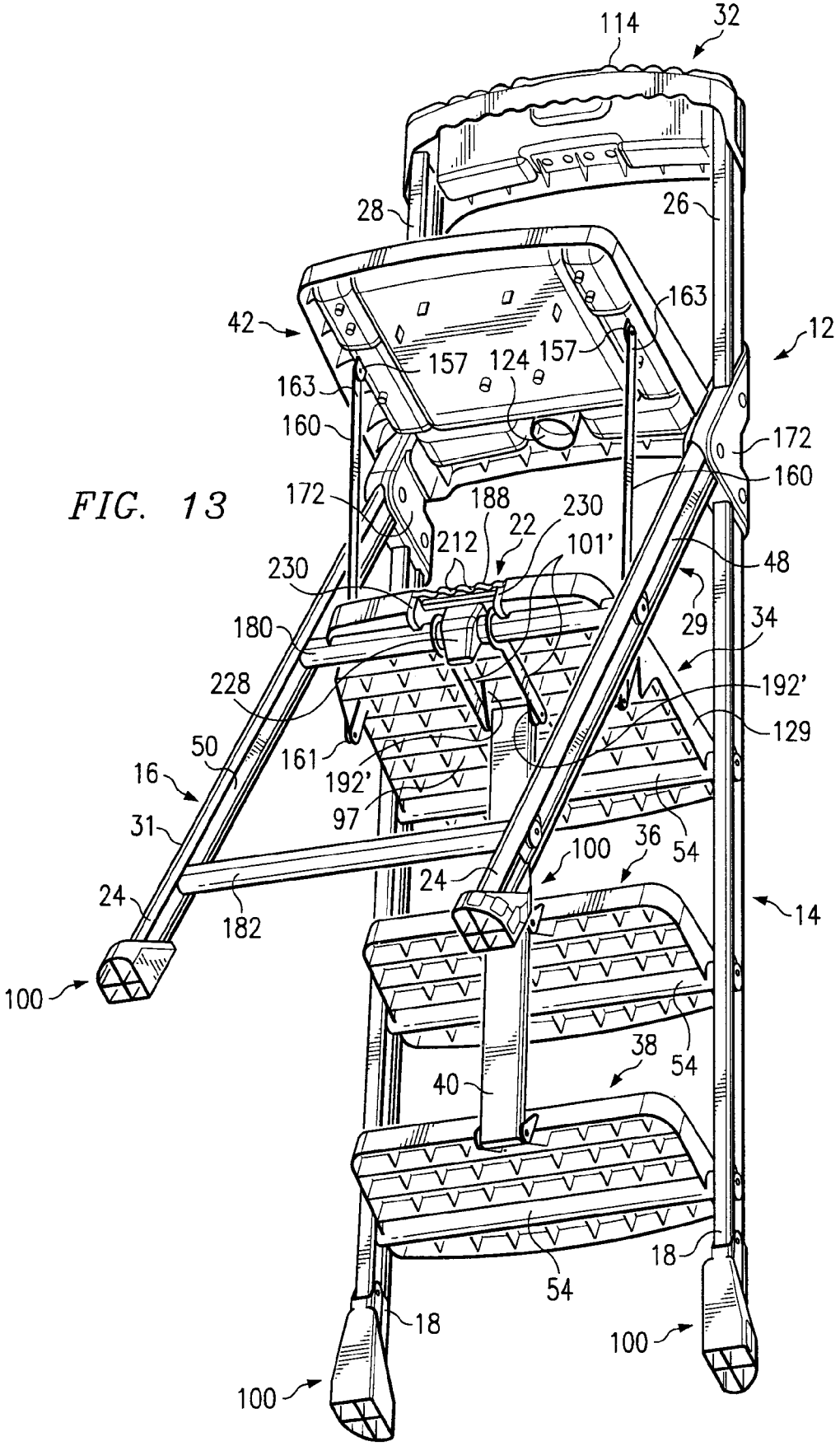
FIG. 13 is a perspective view similar to FIG. 12 showing another placement of the two strut links under the top step.
Figure 14:
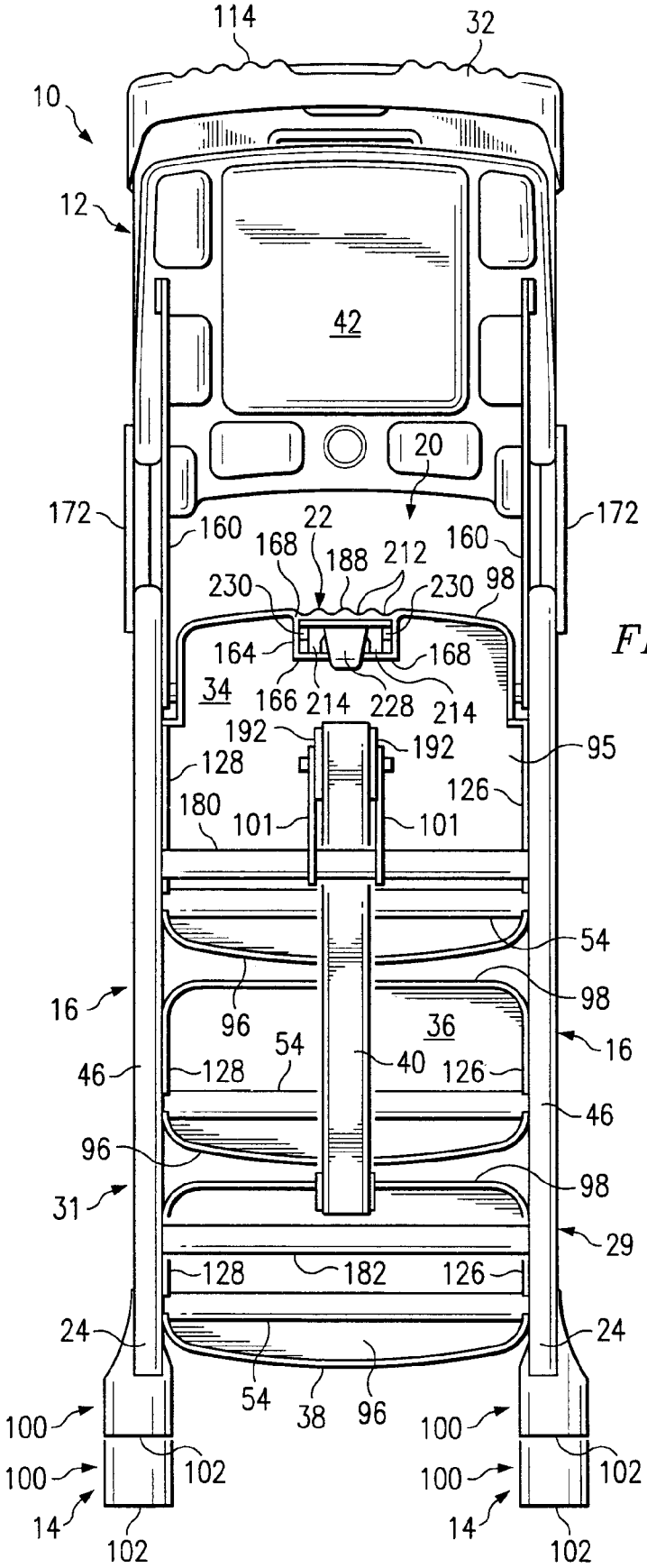
FIG. 14 is a rear elevation view similar to FIG. 5 showing the placement of the two strut links of FIG. 13 under the top step of the step stool.

As shown in FIGS. 5 and 12, top step 34 includes flanges 192. Each one of a pair of strut links 101 is pivotably coupled to flanges 192 at one end and opposite ends are pivotably coupled to upper cross strut 180. In the embodiment shown in FIGS. 13 and 14, strut links 101' and flanges 192' are moved laterally toward the center of top step 34 to lie closer to one another as compared to the strut link and flange placement shown in FIGS. 5 and 12. In other embodiments, strut links 101 could be rigidly connected to upper cross strut 180 and cross strut 180 pivotably coupled to rear leg members 29, 31 to provide pivoting of strut links 101 relative to rear leg members 29, 31.

As shown in FIG. 3, side panels 126, 128 of top step 34 are formed to include flanges 150 extending below lip 129 and away from step surface 94. Each flange 150 is generally triangular in shape and includes front and back edges 152, 154 converging at an apex 156. As shown in FIG. 8, back edge 154 of each flange 150 includes a lock portion 158 that engages upper cross strut 180 of rear leg 16 when step stool 10 is in the use position to prevent rear leg 16 from pivoting toward front leg 14.

As shown in FIGS. 3 and 10, a pair of tray links 160 is provided in step stool 10 and each tray link 160 is coupled at a lower end 161 thereof by a pivot pin 162 to apex 156 of lower tray-link flange 150. As shown in FIG. 12, an upper end 163 of each tray link 160 is coupled to an upper tray-link flange 157 of tray 42 to couple tray 42 to top step 34 so that tray 42 is able to pivot relative to top step 34. Lower tray-link flange 150 extends downwardly below side panel 128 of top step 34 as shown best in FIG. 3 to allow pivot point 162 to lie further "below" top step 34 so as to facilitate folding movement of utility tray 42 relative to front leg 14.

Rear leg 16 of frame 12 is coupled to front leg by a bracket 172 as shown in FIGS. 1–3. Bracket 172 lies adjacent to and is pivotably coupled to utility tray 42. Bracket 172 further includes a pivot pin 174 to permit pivoting movement of rear leg 16 relative to front leg 14, although a wide variety of pins, rods, and joint couplers may be used. Rear leg 16 includes first and second rear leg members 29, 31, upper cross strut 180, and a lower cross strut 182, as shown in FIGS. 1, 2 and 5. Cross struts 180, 182 extend between and are coupled to rear leg members 29, 31. Cross struts 180, 182 are coupled to rear leg members 29, 31 in a manner similar to supports 54 of front leg 14.

Referring now to FIGS. 8–11, upper cross strut 180 includes a support portion 184 and a lock tab 186. Support portion 184 is configured to engage top step 34 when frame 12 is in the use position as shown in FIG. 8. Lock tab 186 of upper cross strut 180 engages releasable latch 22 in the use position to block pivoting movement of rear leg 16 away from front leg 14 and to block top step 34 from pivoting upwardly. When frame 12 is in the use position, steps 20 are in a first position wherein step surfaces 94 face upwardly, generally tangent with support portion 184 of upper cross strut 180. As shown in FIG. 11, as step stool 10 is moving toward the storage position, steps 20 are positioned so that step surfaces 94 are off-set from support portion 184 of upper cross strut 180.

Top step 34 is also formed to include a cavity 164 that contains releasable latch 22 as shown in FIG. 5. Cavity 164 is defined by an end wall 166 and opposing side walls 168 extending from step surface 94. Releasable latch 22 is positioned to lie within cavity 164. Top step 34 also includes a post or spring mount 170 along a rear edge thereof, to be described hereafter, as shown in FIGS. 5, 8, and 9.

Releasable latch 22 is formed to include apertures 194 through which a pin 198 pivotably couples latch 22 to top step 34. Pin 198 defines a pivot axis 216. As shown in FIG. 8, a coiled, compression spring 190 is coupled at one end to latch 22 and at an opposite ends to spring mount 170 formed on top step 34 to bias latch 22 in a generally downward direction 196. Latch 22 has an inner portion 200 which has a recess 202 sized to receive upper cross strut 180. As shown in FIG. 1, upper cross strut 180 is positioned to lie in recess 202, releasably retaining step stool 10 in the use position. As shown in FIG. 11, latch 22 includes a ramped portion 23 defining a cam surface 203 which cams latch 22 over upper strut 180 when step stool 10 moves to the use position. Latch 22 also includes grip portion 188 as shown in FIGS. 9–11.

As shown in FIG. 10, to fold step stool 10, a user applies pressure in a generally upward direction 195 to grip portion 188, disengaging latch 2 from upper cross strut 180. The user then pivots top step 34 to a generally vertical position as shown in FIG. 4, causing a corresponding movement of middle and bottom steps 36, 38 due to the pivotable coupling of each step 34, 36, 38 to central step link 40.

As top step 34 moves to the generally vertical position, strut links 101 pull upper cross strut 180 and thus rear leg 16 toward front leg 14. When step stool 10 is unfolded to the use position as shown in FIG. 1, strut links 101 push upper strut 180 and thus real leg 16 away from front leg 14 in response to downward pressure applied by a user on rear portion 35 of top step 34.

As top step 34 moves to the generally vertical position, central step link 40 causes middle and bottom steps 36, 38 to pivot to also assume a generally vertical position, with steps 34, 36, 38 remaining generally parallel to each other throughout the range of pivoting motion. When step stool 10 is in the storage position as shown in FIG. 4, central step link 40 is positioned to lie in space 139 between mounts 136, 138 of steps 20.

Latch 22 includes a platform 210 including grip portion 188 including depressions 212 adapted for engagement with the fingers of a user and a pair of arms 214 coupled to grip portion 188 and to step 34 for pivotable movement of platform 210 relative to step 34 about a pivot axis 216 defined by pin 198, as shown, for example, in FIGS. 5 and 8–14. Step 34 includes a top surface 218 adapted to be stepped on by a user during use of step stool 10, as shown, for example, in FIGS. 8–11. Platform 210 includes a top surface 220 that is generally co-planar with top surface 218 of the step, as shown, for example, in FIGS. 8–11. Each arm 214 includes a curved surface 226 positioned adjacent to step 34 to allow latch 22 to pivot about pivot axis 216, as shown, for example, in FIGS. 5, 8–11, and 14.

Latch 22 further includes a hook 228 appended to platform 210, as shown, for example, in FIGS. 2, 5, and 8–14. Hook 228. includes cam surface 23 and is formed to include recess 202 sized to receive strut 180.

Latch 22 further includes a pair of spring housings 230 coupled to platform 210 and configured to engage step 34, as shown, for example, in FIGS. 5, 8, and 12–14. Latch 22 includes a pair of springs 190, one of which is shown, for example, in FIG. 8. Each spring 190 engages respective spring housing 230 and step 34 to bias hook 228 toward strut 180, as shown, for example, in FIG. 8. Spring housing 230 includes a curved wall 232 and a shelf 236 coupled curved wall 232, as shown, for example, in FIG. 8. Spring 190 includes coils 234 that engage curved wall 232, as shown, for example, in FIG. 8. Shelf 236 includes a post 242 coupled to a first end 238 of spring 190, as shown, for example, in FIG. 8. Post 170 of step 34 is coupled to a second end 240 of spring 190, as shown, for example, in FIG. 8.

Although the invention has been disclosed in detail with reference to certain preferred embodiments, variations and modifications exist within the scope and spirit of the invention as described and defined in the following claims.

What is claimed is:

1. A step stool comprising a frame including a front leg and a rear leg coupled to the front leg to move relative to the front leg between an opened position and a closed storage position, steps coupled to the front leg to move between a horizontal use position when the rear leg is in the opened use position and a storage position when the rear leg is in the storage position, a step link pivotably coupled to the steps to coordinate simultaneous movement of the steps between the use and storage positions, a tray pivotably coupled to the frame to move between a horizontal use position when the rear leg is in the opened use position and a storage position, and a tray link pivotably coupled to one of the steps and to the tray to coordinate simultaneous movement of the tray between the use and storage positions when the steps move between the use and storage positions.

2. The step stool of claim 1, wherein the tray includes an upper side configured to support objects thereon and an under side facing away from the upper side and the tray link is coupled to the under side of the tray.

3. The step stool of claim 2, wherein the under side of the tray includes a downwardly extending flange and the tray link is coupled to the downwardly extending flange.

4. The step stool of claim 1, wherein the tray includes a first end pivotably coupled to the frame and a second end spaced apart from the firs tend and extending away from the frame and the tray link is coupled to the tray between the first and second ends of the tray.

5. The step stool of claim 1, where one of the steps includes a downwardly extending flange and the tray link is pivotably coupled to the downwardly extending flange.

6. The step stool of claim 5, wherein the step further includes a support panel and a downwardly extending lip coupled to a perimeter of the support panel and the downwardly extending flange is coupled to the lip.

7. The step stool of claim 1, further comprising another tray link pivotably coupled to the tray and one of the steps in a position substantially parallel to the other tray link.

8. The step stool of claim 7, wherein the tray links are coupled to an underside of the tray.

9. The step stool of claim 1, wherein the frame further includes a strut coupled to the rear leg, the step stool further comprising a strut link pivotally coupled to one of the steps and the strut to coordinate movement of the rear leg and the steps.

10. The step stool of claim 9, further comprising a latch coupled to the step, wherein the latch couples to the strut when the rear leg is in the opened position.

11. The step stool of claim 9, wherein the step link, tray link, and strut link are coupled to the same step.

12. The step stool of claim 11, where a latch is coupled to the same leg as the step link, tray link, and strut link.

13. The step stool of claim 1, wherein the step link and the tray link are coupled to an uppermost one of the steps.

14. The step stool of claim 13, wherein the uppermost step extends between the front and rear legs.

15. The step stool of claim 1, wherein the frame further includes a bracket providing the coupling between the front and rear legs and the tray is coupled to the bracket.

16. A step stool comprising a frame including a front leg, a rear leg coupled to the front leg to move relative to the front leg between an opened position and a closed storage position, and a strut coupled to the rear leg, a step pivotably coupled to the front leg to move between a horizontal use position and a storage position, a monolithic strut link coupled to the strut and the step to move the rear leg to the closed storage position upon movement of the step to the storage position.

17. The step stool of claim 16, wherein the step includes a front end pivotably coupled to the front leg and a rear end spaced apart from the front end and the strut link is coupled to the step between the front and rear ends.

18. The step stool of claim 17, wherein the strut link includes a first end coupled to the step and an opposite, second end coupled to the strut, the first end of the strut link is positioned to lie between the second end of the strut link and the rear end of the step in the storage position of the step, and the first end of the strut link is positioned to lie between the second end of the strut link and the front end of the step in the use position of the step.

19. The step stool of claim 17, wherein the strut link is coupled to the step at approximately a midpoint between the front and rear ends of the step.

20. The step stool of claim 17, wherein the step includes a right side extending between the front and rear ends and a lift side extending between the front and rear ends and the strut link is coupled to the step between the right and left sides.

21. The step stool of claim 16, further comprising another step and a step link pivotably coupled to the steps to coordinate movement therebetween.

22. The step stool of claim 21, wherein the strut link is pivotably coupled to one of the steps to rotate about an axis of rotation and the step link is pivotably coupled to said step to rotated about the same axis of rotation.

23. The step stool of claim 21, further comprising another strut link pivotably coupled to the strut and one of the steps, wherein the step link is positioned to lie between the strut links.

24. The step stool of claim 16, wherein the strut link is formed to include a strut-receiving aperture and the strut is positioned to lie in the strut-receiving aperture.

25. The step stool of claim 16, further comprising a latch positioned to couple the step to the strut, the latch being spaced apart from the strut link.

26. The step stool of claim 16, where the strut link is pivotably coupled to an underside of the step.

27. The step stool of claim 26, herein the underside of the step includes a flange extending downwardly in the use position of the step, and the strut link is pivotably coupled to the flange.

28. The step stool of claim 16, wherein the unitary strut link and the strut are positioned to lie in generally perpendicular relation to each other.

29. A step stool comprising a frame including a front leg, rear legs coupled to the front leg, and a strut coupled at its ends to the rear legs, the front and rear legs being configured to move relative to one another between an opened use position and a closed storage position.

a step coupled to the front leg to pivot on the front leg when the front and rear legs are moved between the opened and storage positions, the step including a front edge pivotably coupled to the front leg and a rear edge spaced apart from the front edge, and latch coupled to the step, the latch being positioned to engage the strut when the front and rear legs are in the opened use position, the latch being coupled to the rear edge of the step.

30. The step stool of claim 29, the latch is formed to include a recess sized to receive the strut when engaged therewith.

31. The step stool of claim 29, wherein the step includes a right side extending between front and rear ends and a left side extending between the front and rear ends and spaced apart from the right side and the latch is coupled to the step between the right and left sides.

32. The step stool of claim 31, wherein in the latch is coupled to the step at an approximate midpoint between the right and left sides.

33. The step stool of claim 29, wherein the latch includes a cam surface positioned to engage the strut as the rear leg moves from the storage position to the opened use position and the engagement of the cam surface with the strut pivots the latch permitting the latch to couple to the strut.

34. The step stool of claim 33, wherein the latch includes a latch member defining the cam surface and a recess sized to receive the strut and a spring positioned between the latch member an the step to urge the latch toward the strut.

35. The step stool of claim 33, wherein the latch includes a first end pivotably coupled to the step, a second end defining the cam surface, and a recess sized to receive the strut and positioned to lie between the first and second ends.

36. The step stool of claim 29, wherein the latch includes a recess sized to receive a users fingers, the latch is pivotable between a latched position securing the step to the strut and an unlatched position permitting the step to move relative to the strut.

37. The step stool of claim 29, wherein the latch includes a platform including a grip portion including depressions adapted for engagement with the fingers of a user and an arm coupled to the grip portion and to the step for pivotable movement of the platform relative to the step about a pivot axis.

38. The step stool of claim 37, wherein the latch further includes a spring housing coupled to the platform and a spring that engages the spring housing and the step.

39. The step stool of claim 38, wherein the spring housing includes a curved wall and the spring is a coiled compression spring including coils that engage the curved wall.

40. The step stool of claim 38, wherein the spring housing includes a shelf coupled to the curved wall, the spring includes a first end engaging the shelf and a second end engaging the step.

41. A step stool comprising a frame including a front leg, rear legs coupled to the front leg, and a strut coupled at its ends to the rear legs, the front and rear legs being configured to move relative to one another between an opened use position and a closed storage position, a step coupled to the front leg to pivot on the front leg when the front and rear legs are moved between the opened storage positions, and a latch coupled to the step, the latch being position to engage the strut when the front and rear legs are in the opened use position, the latch including a cam surface positioned to engage the strut as the rear leg moves from the storage position to the opened use position, the engagement of the cam surface with the strut pivoting the latch permitting the latch to couple to the strut.

42. The step stool of claim 41, wherein the latch includes a latch member defining the cam surface and a recess sized to receive the strut and a spring positioned between the latch member and the step to urge the latch toward the strut.

43. The step stool of claim 41, wherein the latch includes a first end pivotably coupled to the step, a second end defining the cam surface, and a recess sized to receive the strut and positioned to lie between the first and second ends.

44. The step stool of claim 41, wherein the latch includes a platform including a grip portion including depressions adapted for engagement with the fingers of a user and an arm coupled to the grip portion and to the step for pivotable movement of the platform relative to the step about a pivot axis.

45. The step stool of claim 44, wherein the step includes a top surface adapted to be stepped on by a user during use of the step stool and the platform includes a top surface that is generally co-planar with the top surface of the step.

46. The step stool of claim 44, wherein the latch further includes a pin that is coupled to the step and the arm and defines the pivot axis.

47. The step stool of claim 44, wherein the arm includes a curved surface positioned adjacent to the step to allow the latch to pivot about the pivot axis.

48. The step stool of claim 44, wherein the latch further includes a hook appended to the platform and the hook includes the cam surface and is formed to include a recess sized to receive the strut.

49. The step stool of claim 48, wherein the latch further includes a spring housing coupled to the platform and a spring that engages the spring housing and the step to bias the hook toward the strut.

50. The step stool of claim 41, wherein the latch further includes a spring housing and a spring that engages the spring housing and the step.

51. The step stool of claim 50, wherein the spring housing includes a curved wall and the spring is a coiled compression spring including coils that engage the curved wall.

52. The step stool of claim 51, wherein the spring housing includes a shelf coupled to the curved wall, the spring includes a first end engaging the shelf and a second end engaging the step.

53. The step stool of claim 50, wherein the spring includes a first end and a second end, the spring housing includes a first post coupled to the first end of the spring, and the step includes a second post coupled to the second end of the spring.

54. A step stool comprising a frame having a first leg including a pair of leg members, a second leg pivotably coupled to the first leg and connectors coupling the strut to the leg, a strut extending between the leg members of the first leg, members of the first leg the first and second legs being configured to move relative to one another between an opened use position and a closed storage position and a step coupled to one of the first and second legs to pivot on said leg when the first and second legs are moved between the opened and storage positions, the leg members of the first leg being formed to include a track having lips and a floor, the connectors being positioned to lie in the track.

55. The step stool of claim 54, wherein each tack has a width and the connector has a length greater than the width of the track to prevent the connector from rotating in the track.

56. The step stool of claim 54, wherein each of the leg members of the first leg is formed to include a second track and opposite ends of the strut are positioned to lie in the respective second track.

57. The step stool of claim 54, wherein the strut is rigid without deforming when the first and second legs move between the use and storage positions.

* * * * *